United States Patent [19]

Amberg

[11] Patent Number: 4,718,555

[45] Date of Patent: Jan. 12, 1988

[54] CARRYING TRAY

[75] Inventor: Christopher P. Amberg, Augusta, Ga.

[73] Assignee: Fort Howard Cup Corporation, Green Bay, Wis.

[21] Appl. No.: 31,937

[22] Filed: Mar. 27, 1987

Related U.S. Application Data

[63] Continuation-in-part of Ser. No. 756,041, Jul. 17, 1985, abandoned.

[51] Int. Cl.[4] ..... B65D 21/02; B65D 1/36; B65D 25/10

[52] U.S. Cl. ..... 206/519; 206/518; 220/20; 220/23.8; 229/2.5 R; 229/DIG. 7; D7/38; D7/71

[58] Field of Search ..... 206/518, 519, 520, 563, 206/203; 229/2.5 R, 29 M, DIG. 7, 1.514; 220/23.8, 20, 85 H; D7/38, 70, 71

[56] References Cited

U.S. PATENT DOCUMENTS

| | | | |
|---|---|---|---|
| D. 274,110 | 6/1984 | Vigue | D7/71 |
| 2,567,054 | 9/1951 | Clement | 229/DIG. 7 |
| 2,766,919 | 10/1956 | Randall . | |
| 2,854,790 | 10/1958 | Hartung | 206/520 |
| 2,878,932 | 3/1959 | Martire | D7/38 |
| 2,928,530 | 3/1960 | Sauey | 229/29 M |
| 3,160,306 | 12/1964 | Smalley | 206/203 |
| 3,197,058 | 7/1965 | Hale | 206/507 |
| 3,601,277 | 8/1971 | Andrews . | |
| 3,638,849 | 2/1972 | Goirgs . | |
| 3,863,759 | 2/1975 | Prodel . | |
| 3,915,371 | 10/1975 | Crabtree | 206/518 |
| 3,942,671 | 3/1976 | Florian | D7/71 |
| 3,944,109 | 3/1976 | Holz | 229/2.5 R |
| 4,054,207 | 10/1977 | Lazure | 206/518 |
| 4,098,403 | 7/1978 | Davis . | |
| 4,156,484 | 5/1979 | Wishusen . | |
| 4,208,006 | 7/1980 | Bixler . | |
| 4,291,805 | 9/1981 | Seeley | 229/2.5 R |
| 4,467,934 | 8/1984 | Hummer | D7/70 |

FOREIGN PATENT DOCUMENTS 412075 8/1974 U.S.S.R. .

*Primary Examiner*—George E. Lowrance

*Attorney, Agent, or Firm*—Jones, Day, Reavis & Pogue

[57] ABSTRACT

The present invention relates to a carrying tray and, more particularly, to a tray which securely holds hot and cold drink cups of various sizes, and is adaptable to hold other items. A plurality of gripping elements in a cup receiving cavity grip and retain a chime-bottomed cup. A flat-bottomed cup is stably supported on a platform in the cup receiving cavity. Various inserts may be selectively used to more stably retain tall cups or to retain other items, such as ice cream cones and the like.

9 Claims, 6 Drawing Figures

CARRYING TRAY

CROSS-REFERENCE TO RELATED APPLICATIONS

This application is a continuation-in-part of Ser. No. 756,041, filed July 17, 1985, now abandoned.

TECHNICAL FIELD

The present invention relates to a carrying tray and, more particularly, to a tray which securely holds hot and cold drink cups of various types and sizes, and is adaptable to securly hold other items, to thereby prevent spillage.

BACKGROUND OF THE INVENTION

The growing number of "fast-food" and carry-out restaurants has brought forth an increased demand for beverage trays which allow the customer to conveniently carry more than one beverage at a time. The wide variety of different types and sizes of hot and cold beverage cups and other food items, such as ice cream cones, sold by these restaurants and the need for prompt and efficient food service requires that a single tray be readily adaptable to securely hold all of these various items.

Generally, a cold beverage cup is constructed with a bottom portion recessed above the bottom of the cup sidewall, thus defining a bottom rim of the cup. This bottom rim is generally referred to as a chime, and such cups are referred to as chime-bottom cups. A conventional hot beverage cup frequently does not have a chime and is referred to as a flat-bottom cup.

Most known trays are commonly constructed of folded cardboard which are erected with one or more panels folded to provide locking support against collapse during use and adapt to different types and sizes of food and drink items. There are many disadvantages with these types of trays. They lack rigidity to firmly hold the cups without spilling. Moreover, if the panels are not folded correctly it is easy for a cup to tip over. The tray also must be properly folded to fit the particular item intended to be carried. Once liquid has spilled onto the cardboard, the tray deteriorates and provides even less support. Additionally, most known trays can not accommodate a wide range of different type and size cups and other related food items while maintaining a firm grip on the cup to prevent spillage. In most prior known devices, if the cup opening in the tray is sized such that a large size cup is held in a stable position, a smaller sized cup will be able to slide or tilt within the opening. If the cup opening is sized such that a small size cup is stably supported, a larger size cup will not be accommodated. If the larger size cup is forced into the smaller opening, it will either destroy the structural integrity of the tray, or it will not be properly supported on the tray bottom, thus resulting in a highly unstable condition.

Some prior known trays have been designed to accommodate cups of difference sizes. However, these known designs are not able to securely hold a wide variety of both flat-bottomed and chime-bottomed cups of various sizes.

The present invention overcomes the above disadvantages by using a light weight, plastic try designed to securely grip and support beverage cups of various types and sizes. The tray may be efficiently formed of a single piece to reduce manufacturing costs. The plastic material will not deteriorate, leak or lose its ability to support the cups when wet. The tray is further cost effective in that it does not require a fast-food employee's time to assemble.

SUMMARY OF THE INVENTION

The present invention is directed to a one-piece, plastic, generally rectangular carryout beverage tray comprising a base with upwardly extending side walls about its periphery. Preferably, the sidewalls are sufficiently high to provide stability over a substantial portion of a cup's height. A portion of the sidewall is indented inwardly to form a protrusion which projects inwardly from substantially the center of each sidewall portion. A center post projects upwardly from substantially the center of the base portion. Preferably, the center post is circular in shape. A bridge element connects each of the sidewall protrusions elements to the center post. The tray includes a plurality of cup receiving cavities. The sidewalls of each cavity are defined by the sidewall protrusions, the center post, the sidewall portion of the tray, and the bridge elements. Each cup receiving cavity is designed to receive and retain one of a plurality of different sized and type beverage cups.

A bottom platform is positioned in each of the cup receiving cavities. The platform projects upwardly from the base portion of the tray and provides a flat area for stably supporting a flat-bottom cup, such as a conventional foam cup used for holding hot liquids. The circumferential sidewalls of the raised platform are spaced from the sidewalls of the cup receiving cavity so that a substantially circular groove or trough surrounds the bottom platform. The platform preferably is positioned off-center within the cup receiving cavity.

First and second gripping elements are positioned within each of the cup receiving cavities. The gripping elements project upwardly from the base portion of the tray and serve to grip the chime of a chime-bottom cup. The gripping means are radially spaced from each other so that the chime portion of a first size chime-bottom cup is gripped between the first and second gripping means, and the chime portion of a second size chime-bottom cup is gripped between the second gripping element and the sidewall of the cup receiving cavity. Of course, additional gripping elements could be provided.

Preferably, the first gripping means comprises an arcuate-walled projection integrally formed on the sidewall of the raised bottom platform. In the preferred form of the invention, the arcuate shape of the first gripping means substantially conforms to the shape of a portion of the chime of a substantially circular chime-bottom cup. The second gripping means, in a preferred form of the invention, also is arcuate in shape to substantially conform to the shape of a portion of the chime of a larger diameter chime-bottom cup. Preferably, the second gripping element is positioned opposite and spaced from the first gripping element. Also, preferably the first and second gripping elements have different radial center points within each of the cup receiving cavities so that the space between the gripping elements varies along their curvature.

The carrying tray of the present invention also comprises a plurality of hand gripping recesses for conveniently carrying the tray. The hand gripping recesses are formed by the undersides of the upwardly projecting center post, the protrusion elements, and the bridge elements.

For large capacity tall cups, it may be desirable to provide additional retaining means. Accordingly, the present invention further comprises a removable retaining insert. Preferably, the retaining insert is supported by the top surface of the protrusion elements and fits around a nesting lug positioned on the protrusion elements. The retaining insert may also be formed so that it can retain other items, such as ice cream cones.

The carrying tray of the present invention is preferably made from a one-piece plastic material impermeable to liquid. The preferred material is somewhat flexible to enhance the ability of the user to get a firm grip on both the tray and the cups within the tray.

Various advantages and features of novelty which characterize the present invention are pointed out with particularity in the claims. However, for a better understanding of the invention, reference should be made to the drawings and to the accompanying descriptive matter in which there is illustrated and described the preferred embodiment of the present invention.

DETAILED DESCRIPTION

Figure 1:
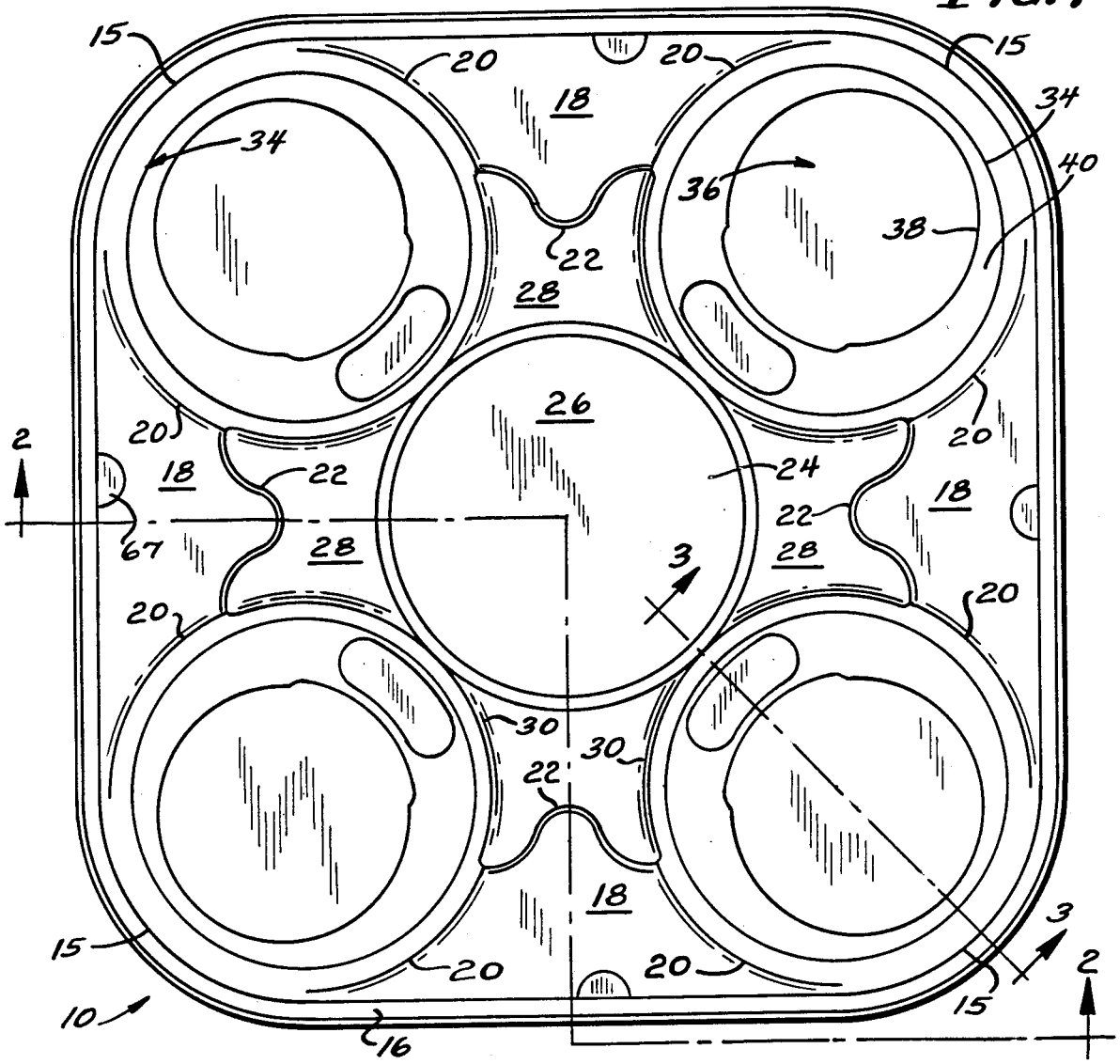
FIG. 1 is a top view of a carrying tray in accordance with the present invention.
Figure 2:
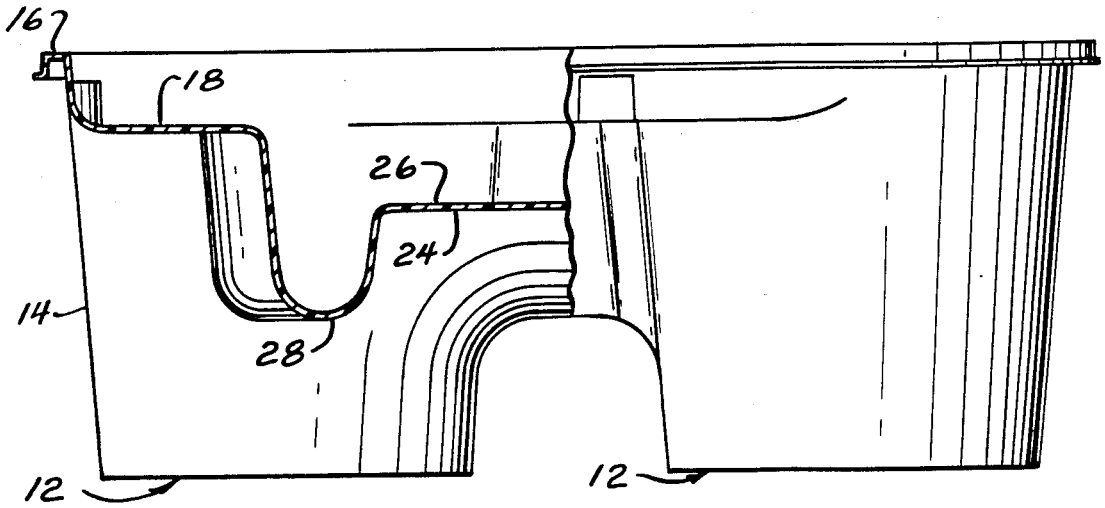
FIG. 2 is a view taken along line 2—2 of FIG. 1.
Figure 3:
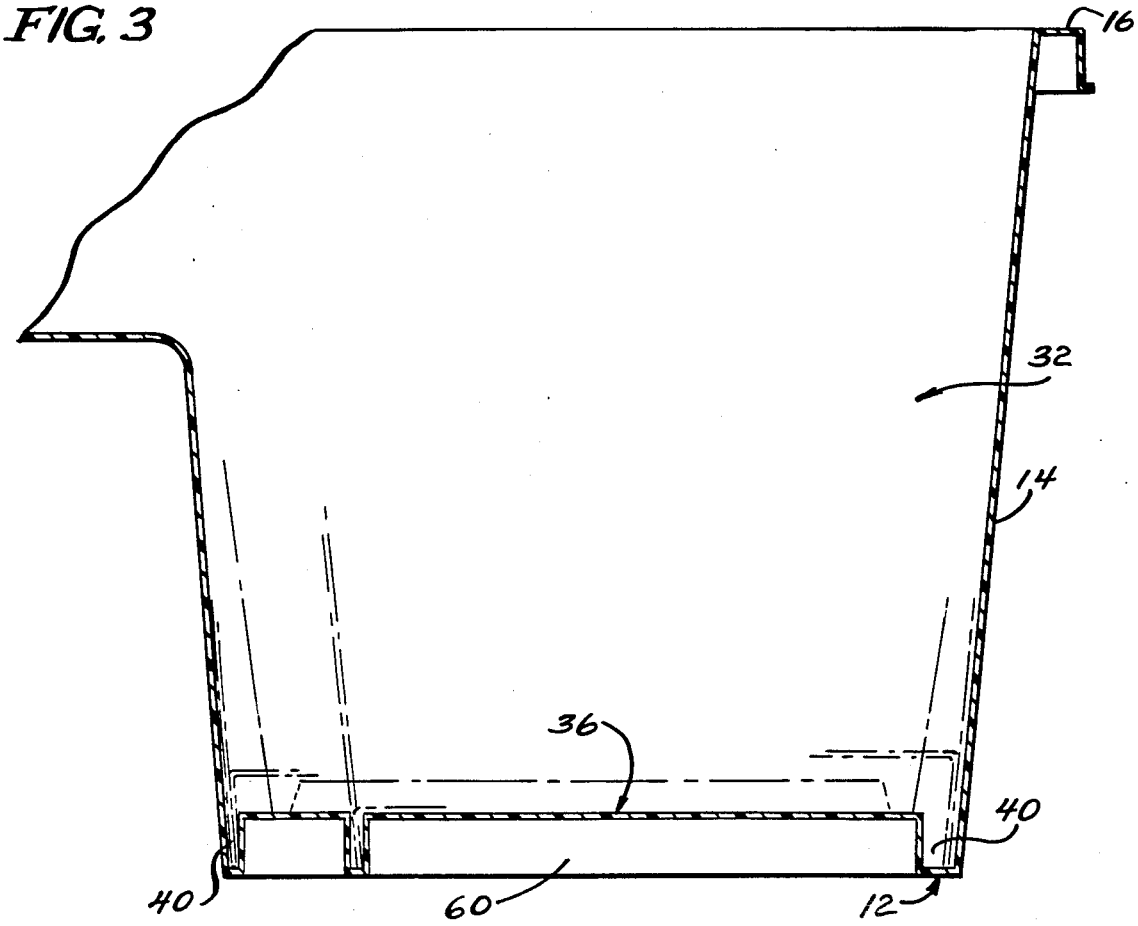
FIG. 3 is a view taken along line 3—3 of FIG. 1.

In FIG. 1 is illustrated a beverage tray in accordance with the present invention, generally designated as 10. Although tray 10 is shown in a generally rectangular configuration designed to hold four beverage cups, this is for purposes of description of a preferred embodiment only. Tray 10 may be designed and sized to carry any number of beverage cups. Additionally, tray 10 may be designed to hold cups of any size range, although a range from 6 ounce through 24 ounce cups would likely be the most popular commercial range. Preferably, tray 10 is constructed by pressing or thermoforming a one-piece polysterene material. This material is sufficiently rigid to provide a firm support for the cups, is lightweight, and is nonporous. Other similar materials or construction techniques may be used.

Tray 10 includes base 12 with an upstanding sidewall 14 around the periphery thereof. A reverse flange 16 surrounds the upper periphery of sidewall 14. At each corner of the preferred embodiment shown in FIG. 1, the sidewalls 14 have a curved contour 15 with a radius of curvature sufficiently large to accommodate the largest sized cup which the tray is intended to carry.

A protrusion 18 is formed in the center of each side wall. Each of the protrusions is identical in shape and construction. Each protrusion preferably is formed as a continuous indentation of the sidewall. The protrusions include sidewalls 20 which curve inwardly toward the center of tray 10. Protrusion sidewalls 20 have a common radial center point with the curved sidewall 15. Protrusion sidewalls 20 terminate in a bell-shaped curve 22 which adds rigidity to the structure.

A center post 24 projects upwardly from substantially the center of base 12. Preferably center post 24 is round and has a flat planar top surface 26 suitable for imprinting or otherwise marking with a company name or logo. Alternatively, center post 24 could be formed with a shallow well (not shown) which would hold cream, sugar or similar packaged condiments. Preferably, center post 24 projects upwardly to extend over a substantial portion of the height of cups intended to be carried by tray 10.

A bridge 28 connects each of protrusions 18 to center post 24. Bridge 28 has curved sidewalls 30. As shown in the drawings, bridge 28 preferably is lower in height than either protrusions 18 or center post 24.

In the preferred form of the invention shown in the drawings, tray 10 comprises four cup receiving cavities 32. The sidewalls 34 of cavities 32 are defined by curved sidewalls 30 of bridge 28, the sidewalls of center post 24, and protrusion sidewalls 20. Cup-receiving cavities 32 may be formed in any other manner, such as by merely forming a plurality of circular or tapered pockets or cavities in base 12 sufficiently deep to accommodate a beverage cup.

As shown in the drawings, cavities 32 are generally circular in shape and conform to the general diameter and shape of conventional beverage cups ranging in size from 6 ounce to 24 ounce capacity. The depth of cavities 32 is sufficient to cover a substantial portion of the cup sidewall to provide additional stability when carrying a cup. An overall tray height of approximately 2.75 inches has been found preferable to provide the proper sidewall support. The cup-holding cavities may be tapered to better conform to the tapered shape of most beverage cups.

A raised bottom platform 36 is formed in each of cavities 32. Platform 36 projects upwardly from base 12, having a substantially flat, planar top surface. Platform 36 is substantially circular, with its circumferential sidewall 38 spaced from the sidewall 34 of cavities 32, thus creating a groove 40 in which the chime of a chime-bottom cup is retained, as explained in detail below.

Figure 4:
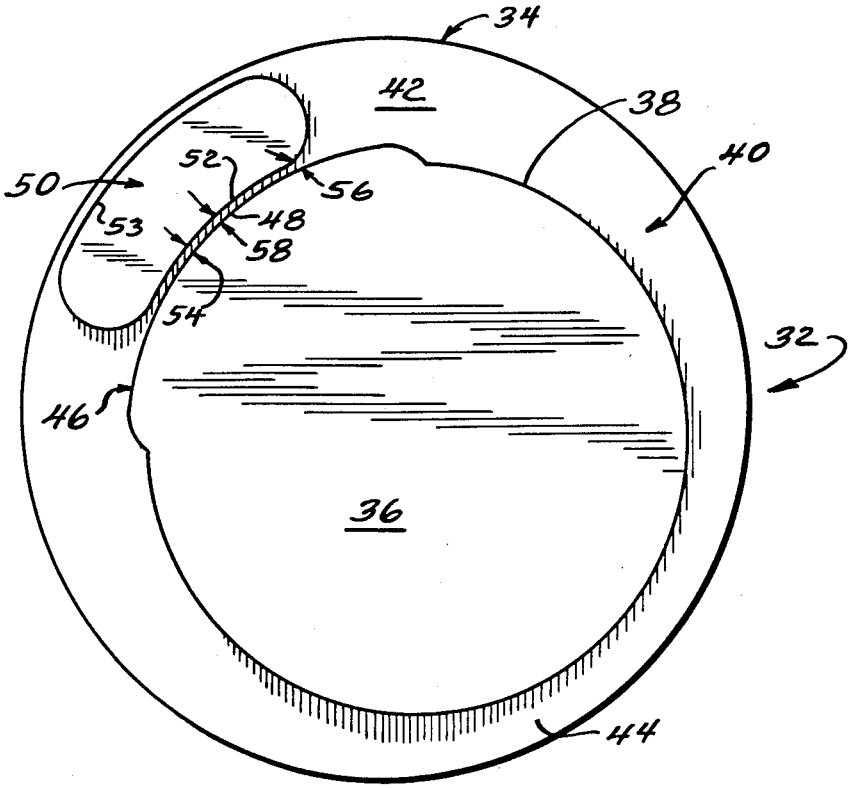
FIG. 4 is a top plan view of one of the cup receiving cavities of the present invention.

As shown in FIG. 4, the radial center point of platform 36 is offset from the radial center point of cavity 32. Thus groove 40 is wider on the inner side of cavity 32, as shown at 42, than on the outer side, as shown at 44. This asymmetric positioning of platform 36 forces proper placement of a chime-bottom 12-ounce cup to be carried by tray 10 to thus obtain gripping of the 12-ounce cup, as explained in detail below.

An arcuate walled projection 46 is formed on the inner side of platform 36. Preferably projection 46 is formed integral with the sidewall of platform 36, as shown in FIG. 4. The center point for the curved wall 48 of projection 46 is the same as the center point for platform 36. Of course, the radius of curved wall 48 is greater than the radius of platform 36.

An arcuate walled gripping element 50 projects upwardly from base 12 of tray 10. Gripping element 50 is positioned opposite and spaced from projection 46. The upward projection of element 50 is substantially equal to the upward projection of platform 36 and projection 46. The radial center point for the curved sidewall 52 of element 50 is the same as the radial center point of cavity 36. Thus, sidewall 52 of gripping element 50 and sidewall 48 of projection 46 have different radial center points. Accordingly, as shown in FIG. 4, the distance 54 between sidewall 52 and sidewall 48 varies along their curvature, i.e., distance 56 is less than distance 58.

The underside 60 of tray 10 comprises a series of complementary recesses formed by the upward projections of center post 24, protrusions 18, bridge 28 and downward projections formed by cavities 32. These underside projections and recesses provide hand grips for conveniently and securely carrying tray 10.

Figure 5:
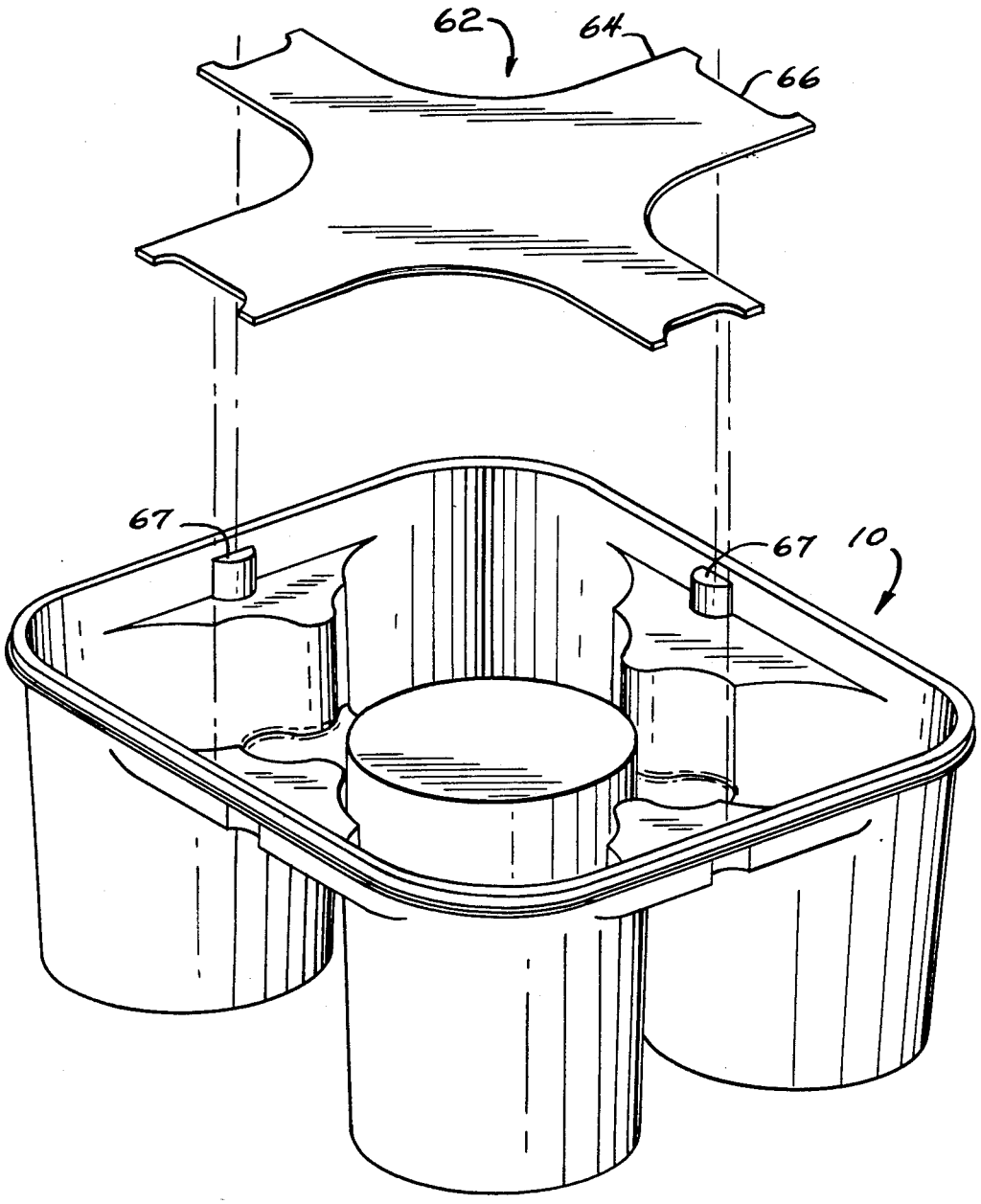
FIG. 5 is a perspective view of one form of retaining insert according to the present invention.
Figure 6:
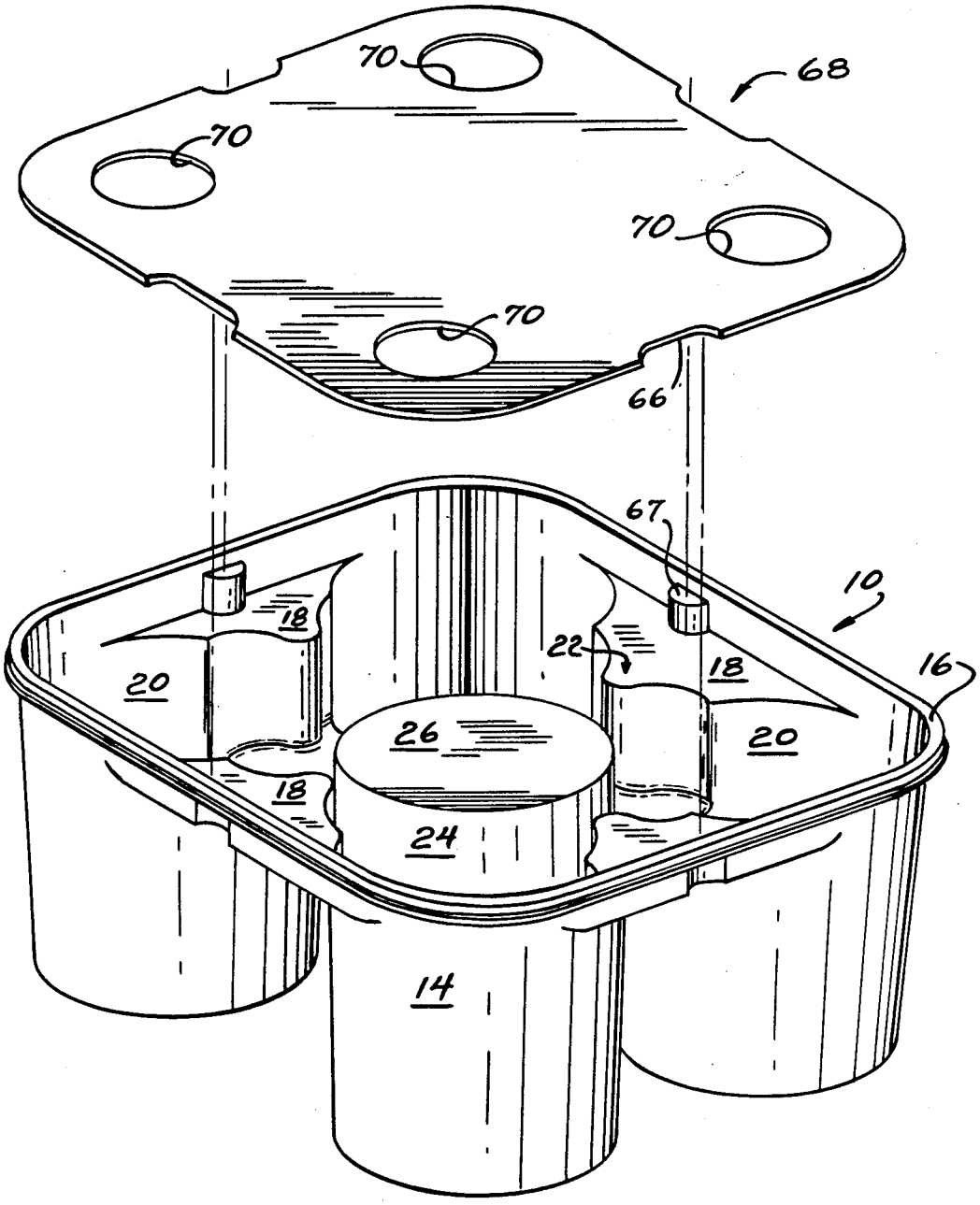
FIG. 6 is a perspective view of another form of retaining insert according to the invention.

As shown in FIGS. 5 and 6, a retaining insert 62, 68 may be used with tray 10 to provide further support for beverage cups carried in the tray or to facilitate carrying odd shaped items such as ice cream cones. Preferably, these inserts are made from cardboard or a similar material.

As shown in FIG. 5, insert 62 is a cross-shaped member having smoothly curved sidewalls 64 which substantially conform to the shape of a beverage cup in cavity 32. A cut-out 66 is formed in each leg of insert 62. Cut-out 66 fits over nesting legs 67 on the top surface of protusions 18, with insert 62 supported by the top surface of protrusion 18. Cut-out 66 serves to properly position and retain insert 62 in place. Insert 62 would likely be used with large cups which required additional stability and support.

As shown in FIG. 6, insert 68 comprises a substantially rectangular member having a plurality of circular openings 70. Openings 70 are positioned directly over cavities 32 so that a long-stemmed item, such as an ice cream cone, can be securely supported and retained within openings 70. Of course, other shaped inserts also may be used to accommodate the shape of other specialty items which may be carried in tray 10.

The operation of tray 10 will now be described. As is evident, tray 10 does not require any assembly, which substantially simplifies its use in a fast-food restaurant. A stack of nested trays are readily separated because of the spaces between the tray created by nesting lugs 67. Tray 10 is particularly adapted for carrying a conventional 12-ounce, 16-ounce and 22-ounce cold drink, chime-bottom cups. When using a 12-ounce cup, the chime fits within groove 40 between projection 46 and gripping element 50. The assymetric positioning of platform 36 forces the 12-ounce cup to the outer side of cavity 36 to also get gripping of the cup on the outer sidewall of cavity 32. The chime of the 12-ounce cup, however, does not contact the outer sidewall of platform 36. The differing distance 54 between sidewall 52 and sidewall 48 insures at least two point contact on the chime of the retained cup and allows for slight variations in the radius of the cup bottom as a result of manufacturing tolerances or caused by filling with liquid or ice.

The chime of a 16-ounce and 22-ounce cup is retained within groove 40 between the outer surface 53 of gripping element 50 and the sidewall of cavity 32. The larger sized cups, i.e., a 16 or 22-ounce cup have full surface contact on the outboard side 52 of gripping element 50 as well as circumferential contact by the outboard side of sidewall 34 of cavity 32. Additionally, the larger size cups contact the curved wall of center post 24, thus providing a highly stable support for these larger cups.

Platform 36 is sized so that a 8 and 12-ounce flat bottomed conventional hot cup will be stably and securely retained on the platform. Of course, with the flat bottomed cup, there is no gripping by the gripping elements 46 and 50. However, the sidewalls of cavity 32 and center post 24 prevent the flat bottom cup from tipping. Thus, these elements should be sufficiently high to securely retain both an 8 ounce and 12 ounce flat bottomed cup in place.

The flexibility of the plastic material allows the user to grip the underside downward extension of cavities 32 and securely hold the tray. The underside of bridges and sidewall protrusions give additional gripping surfaces.

Numerous characteristics and advantages of the invention have been set forth in the foregoing description, together with the details of the structure and function of the invention, and the novel features thereof are pointed out in the appended claims. The disclosure, however, is illustrative only and changes may be made in detail, especially in matters of shape, size and arrangement of parts, within the principle of the invention, to the full extent indicated by the broad general meaning of the terms in which the appended claims are expressed.

I claim:

1. A beverage tray for securely carrying beverage cups of various types and sizes comprising:

a base portion;

sidewall portions extending upwardly from the periphery of said base portion to provide stability over a substantial portion of a cup's height;

protrusion means projecting inwardly from substantially the center of each sidewall portion, said protrusion means partially defining the sidewalls of a cup receiving cavity;

a center post projecting upwardly from substantially the center of said base portion, said center post partially defining the sidewalls of a cup receiving cavity;

bridge means connecting each of said protrusion means to said center post, said bridge means partially defining the sidewalls of a cup receiving cavity;

a plurality of cup receiving cavities, sidewalls of said cavity defined by said protrusion means, said center post, said sidewall portions and said bridge means, said cavities designed to receive and retain one of a plurality of different sized and type beverage cups;

a bottom platform in each of said cup receiving cavities, said platform projecting upwardly from said base portion for stably supporting a flat-bottomed cup, the circumferential side walls of said platform spaced from said sidewalls of said cup receiving cavity;

first gripping means projecting upwardly from said base portion for gripping the chime of a chime-bottom cup; and second gripping means projecting upwardly from said base portion within each of said cavities for gripping the chime of a chime-bottom cup, said second gripping means radially spaced from said first gripping means whereby the chime portion of a first sized chime-bottom cup is gripped between said first and said second gripping means and the chime portion of a second sized cup is gripped between said second gripping means and said sidewall of said cavity.

2. A beverage tray as recited in claim 1 wherein said first gripping means comprises an arcuate-walled projection integrally formed on the sidewall of said platform, wherein said second gripping means is arcuate in shape to substantially conform to the shape of a portion of the chime of a chime-bottom cup, wherein said second gripping means is positioned opposite and spaced from said first gripping means and wherein said first and second gripping means have different radial center points so that the space between said gripping means varies along their curvature.

3. A beverage tray as recited in claim 2 wherein said platform is asymmetrically positioned within said cup receiving cavity.

4. A beverage tray as recited in claim 3 wherein the underside of said base portion comprises a plurality of hand gripping recesses for conveniently carrying the tray.

5. A beverage tray as recited in claim 4 wherein said hand gripping recesses are formed by the undersides of said upwardly projecting center post, said protrusion means, and said bridge means.

6. A beverage tray as recited in claim 1 further comprising a retaining insert removably inserted in the beverage tray cup.

7. A beverage tray as recited in claim 6 further comprising a nesting lug on the top surface of each of said protrusion means, and wherein said retaining insert is supported by said top surface of said protrusion means.

8. A beverage tray as recited in claim 6 wherein said retaining insert comprises an opening over each of said cup receiving cavities.

9. A beverage tray as recited in claim 1 wherein said tray is made from a one-piece plastic material impermeable to liquid to thereby retain within the tray any spilled liquid from the cups.

* * * * *